United States Patent [19]

Steinbrenner et al.

[11] 4,180,025

[45] Dec. 25, 1979

[54] FUEL INJECTION SYSTEM

[75] Inventors: Ulrich Steinbrenner, Stuttgart; Dieter Kirn, Asperg; Hans Schnürle, Walheim, all of Fed. Rep. of Germany

[73] Assignee: Robert Bosch GmbH, Stuttgart, Fed. Rep. of Germany

[21] Appl. No.: 766,639

[22] Filed: Feb. 8, 1977

[30] Foreign Application Priority Data

Feb. 10, 1976 [DE] Fed. Rep. of Germany ..... 2605059

[51] Int. Cl.[2] ..... F02B 3/00

[52] U.S. Cl. ..... 123/32 EA

[58] Field of Search ..... 123/32 EA, 32 AB, 32 EA, 123/32 ED, 32 JT

[56] References Cited

U.S. PATENT DOCUMENTS

| | | | |
|---|---|---|---|
| 3,620,196 | 11/1971 | Wessel | 123/32 EA |
| 3,645,240 | 2/1972 | Monpetit | 123/32 EA |
| 3,741,171 | 6/1973 | Dautel | 123/32 EA |
| 4,084,552 | 4/1978 | Drews et al. | 123/32 EA |

FOREIGN PATENT DOCUMENTS

| | | | |
|---|---|---|---|
| 2547027 | 4/1977 | Fed. Rep. of Germany | 123/32 EA |

*Primary Examiner*—Charles T. Jordan

*Attorney, Agent, or Firm*—Edwin E. Greigg

[57] ABSTRACT

A fuel injection system which employs electromagnetic injection valves controlled by injection control pulses of variable width. When the engine is being operated in the overrunning condition, with closed throttle and elevated rpm, the normally provided fuel injection control pulses can be supplanted by substitute pulses of either constant or variable width. The apparatus includes a comparator circuit which determines whether the original control pulse is to be used or the substitute pulse. Several embodiments are presented.

21 Claims, 10 Drawing Figures

FUEL INJECTION SYSTEM

BACKGROUND OF THE INVENTION

The invention relates to a fuel injection system for maintaining suitable operational conditions during passive operation (engine overrun, for example during downhill operation) and during the transition from passive operation to active operation. The fuel injection system includes a circuit which generates triggering pulses in proportion to the engine rpm and also a control multivibrator for generating fuel injection control pulses, the duration of which is determined substantially by the engine rpm and the aspirated air quantity. These control pulses are fed, after possible further correction, to electromagnetic fuel injection valves.

Already known are intermittently or continuously operating fuel injection systems which provide fuel in the required and desired ratio to the aspirated air quantity in accordance with the needs of the engine. In such systems, a large number of sensors determines the prevailing operational condition of the engine and generates injection control signals which are fed to the injection valves so that the fuel requirements are adapted precisely to the prevailing condition of the engine and to the desires of the operator. The primary variables used for metering out the fuel to an internal combustion engine in the known system are the rpm of the engine and the air quantity per stroke. Mainly from these two values, the injection system calculates the duration of the injection pulses. However, a particular operational state of the engine is difficult to determine with customary sensors and is also difficult to translate into injection control pulses of suitable duration. One of the unusual conditions is, for example, the situation when the operator of a vehicle which had been running at high engine rpm suddenly removes his foot from the gas pedal, permitting the throttle plate to return to its idling position. In that case, the fuel injection system receives sensor signals indicating relatively high engine rpm as well as substantial vacuum in the induction manifold but the throttle plate is in its zero position so that the engine operates as a passive prime mover, i.e., as if it were pushed, and the torque M supplied by the engine assumes negative values.

Even under such rapidly changing conditions and the onset of engine overrunning, the fuel injection system must be capable to provide a fuel mixture that does not detonate in the exhaust system even when the operator reaccelerates from that condition. Furthermore, the fuel mixture must be such as to maintain an acceptable exhaust gas composition in such operation.

OBJECT AND SUMMARY OF THE INVENTION

It is accordingly a principal object of the invention to provide a fuel injection system which maintains satisfactory engine operation during engine overrunning and during the transition from passive to active engine operation.

This and other objects are attained, according to the invention, by providing a basic fuel injection system of the type described above, improved by the inclusion of a comparator circuit for comparing a constant pre-pulse of short duration of given polarity with a simultaneous comparison pulse of opposite polarity and changeable magnitude. The invention further provides a storage circuit which is subject to previous operational conditions, for example the rpm, and which determines the magnitude of the comparison pulse. Still further, the invention provides that the comparator circuit opens and closes a subsequent transfer circuit for the fuel injection pulses and yet further provides a timing circuit for generating an injection pulse of minimum duration.

A fuel injection system of this type is capable of increasing the duration of the fuel injection pulses independently of any calculations made by other circuit components of the fuel injection system and related to the prevailing conditions of engine overrun. Thus, during passive engine operation, an additional fuel quantity is supplied to the engine permitting orderly combustion. Such additional fuel supply is particularly important if the vehicle is equipped with an after-burner or catalyzer because uncombusted fuel would cause rapid heating and eventual destruction of such devices. However, it has been found that, beginning with a certain induction tube pressure, even an increase of the fuel quantity, either by actually increasing the fuel or by providing a minimum injection pulse, no longer achieves combustion so that, in overrunning operation, the engine tends to produce detonations and irregular operation which it also does during accelerations from that operation. Detonation and explosions, as well as so-called motor-boating, occur when uncombusted fuel is ignited in the exhaust system or when fuel already collected in the exhaust system is ignited by the first combusted exhaust products from the engine.

For this reason, the circuit according to the invention not only performs the so-called overrun increase, i.e., an increase of the fuel quantity to maintain orderly combustion, but, beginning with certain operational states of the engine, it completely interrupts the fuel supply or at least to a degree which prevents an undesired detonation of fuel in the exhaust system or other undesirable engine operations.

It has been shown that the fuel injection system described by this invention is capable of insuring lower concentrations of undesirable exhaust gas components over the entire range of engine speeds in which these undesirable conditions may occur. The system also prevents explosions and motor-boating during engine overrun and acceleration from engine overrun over the entire domain of engine speeds. Furthermore, the system of the invention produces fuel savings yet insures a satisfactory behavior of the vehicle equipped with an engine of this type.

Inasmuch as different engine types exhibit varying behavior to the operational conditions described above, it is furthermore required that a generalized fuel injection system include the capability of being adapted to the characteristics of a particular engine. For this reason, the invention includes several variants which are embodied in somewhat different manner.

The invention will be better understood as well as further objects and advantages thereof become more apparent from the ensuing detailed description of four exemplary embodiments taken in conjunction with the drawing.

BRIEF DESCRIPTION OF THE DRAWING

FIG. 3 is a circuit diagram of a first embodiment of a fuel injection system according to the invention resulting in the diagram of FIG. 2a;

DESCRIPTION OF THE PREFERRED EMBODIMENTS

In the following description there will be an initial discussion of the overall circuit diagram of FIG. 1. Subsequently, the individual circuits I–IV will be explained in sequence, making simultaneous reference to the curves 2a to 2d generated by these circuits and the various voltage diagrams according to FIGS. 7–10.

Figure 1:
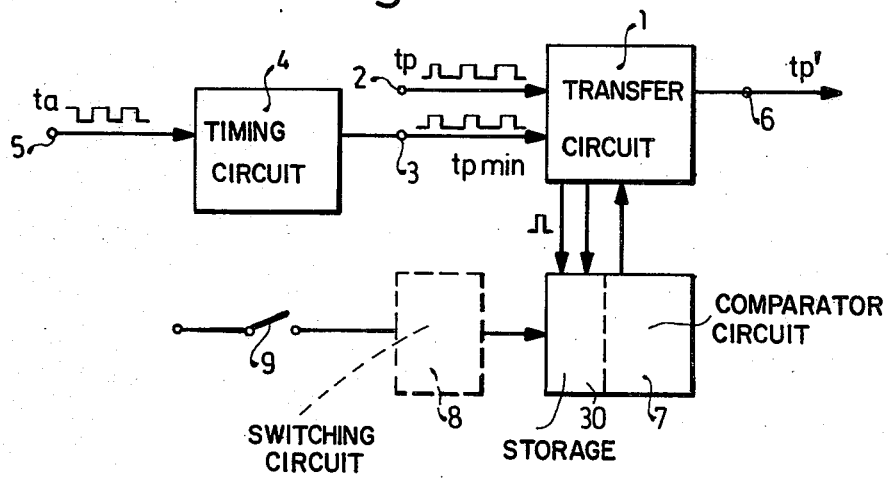
FIG. 1 is an overall block circuit diagram of the fuel injection system according to the invention.

FIG. 1 illustrates the overall arrangement of a fuel injection system according to the invention including blocks which are substantially present in every one of the subsequently illustrated circuits I–IV. There is always present a transfer circuit 1, one of the inputs of which receives a sequence of injection pulses $t_p$ which will be explained in more detail below. A further input receives a pulse train $t_{pmin}$ which is synchronous with the pulse train $t_p$. The pulse train $t_{pmin}$ is formed by a timing circuit 4. At a contact 5, the timing circuit 4 receives a so-called trigger pulse train which is rpm synchronous and the generation of which will be explained in more detail below. The timing circuit uses the negative going edge of the triggering pulses to form the injection pulses of minimum duration $t_{pmin}$ of constant width. It is possible to do this because the trigger pulse train $t_a$ and the injection pulse train $t_p$ are produced by other circuit components of the injection system which is not subject of the present invention per se, in time synchronous manner. Generally, the non-represented portion of the fuel injection system is so embodied as to provide a triggering circuit which receives rpm-dependent information from the engine and the output of which generates the above-mentioned triggering pulse train $t_a$ at a frequency proportional to rpm and with a keying ratio of one-half. A further non-illustrated part of the fuel injection system forms the injection pulses $t_p$ by using the just-described pulse train $t_a$. This part of the fuel injection system may be described as a control multivibrator circuit and it receives information regarding the prevailing rpm of the engine and the aspirated air quantity and is triggered by the triggering pulse train $t_a$ and forms the output pulse train $t_p$, the duration of which substantially defines the duration of opening of the injection valves which are actually controlled by final control pulses $t_i$. The control multivibrator circuit need not be discussed in detail but it will be mentioned that it includes a monostable multivibrator having a feedback branch including a timing capacitor. The time constant of the multivibrator is defined by the recharging time of this capacitor. That time, in turn, is determined by the effect of charging and discharging current sources wherein the discharge current is a measure of the air quantity fed to the engine and the otherwise constant charging current is turned on during a time which is inversely proportional to the prevailing rpm of the engine so that the final charge on the timing capacitor is a measure of the rpm. This control multivibrator circuit generates the output pulses $t_p$ which, in the normal situation, are not altered by the transfer circuit 1 and thus appear unaltered at its output contact 6 whenever the fuel injection system is operating normally. On the other hand, if the engine is operating in an overrun condition, the comparator circuit 7 associated with the transfer circuit 1 is capable of completely interrupting the transfer of the injection pulses $t_p$. Furthermore, the circuit of FIG. 1 is capable of generating and transmitting a pulse train $t_{pmin}$ having a minimum duration whenever the injection pulse train $t_p$ would deliver pulses the duration of which is too short for practical use. A correcting circuit may be connected behind the contact 6 for forming the final fuel injection control pulse train $t_i$ from the injection pulse train $t_p$ by the inclusion of one or more correcting factors.

Finally, the circuit of FIG. 1 also includes a switching circuit 8 associated with the comparator 7 the condition of which is determined by a throttle plate switch 9. This switch permits a clear indication of the position of the throttle plate and shows whether the engine is being operated in an overrunning condition. In some of the circuits to be described below, the switching circuit 8 may be dispensed with.

Figure 2:
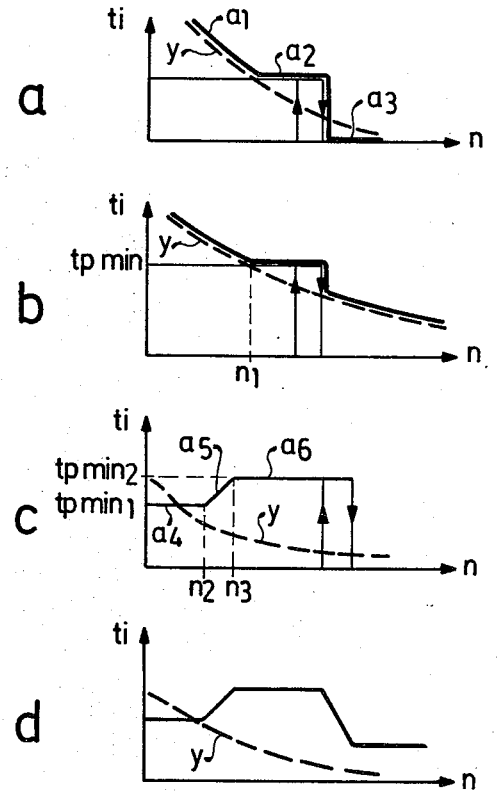
FIG. 2 is a series of four diagrams illustrating the dependence of the duration of the fuel injection pulses on engine rpm during engine overrun for four different exemplary embodiments of the invention.
Figure 3:
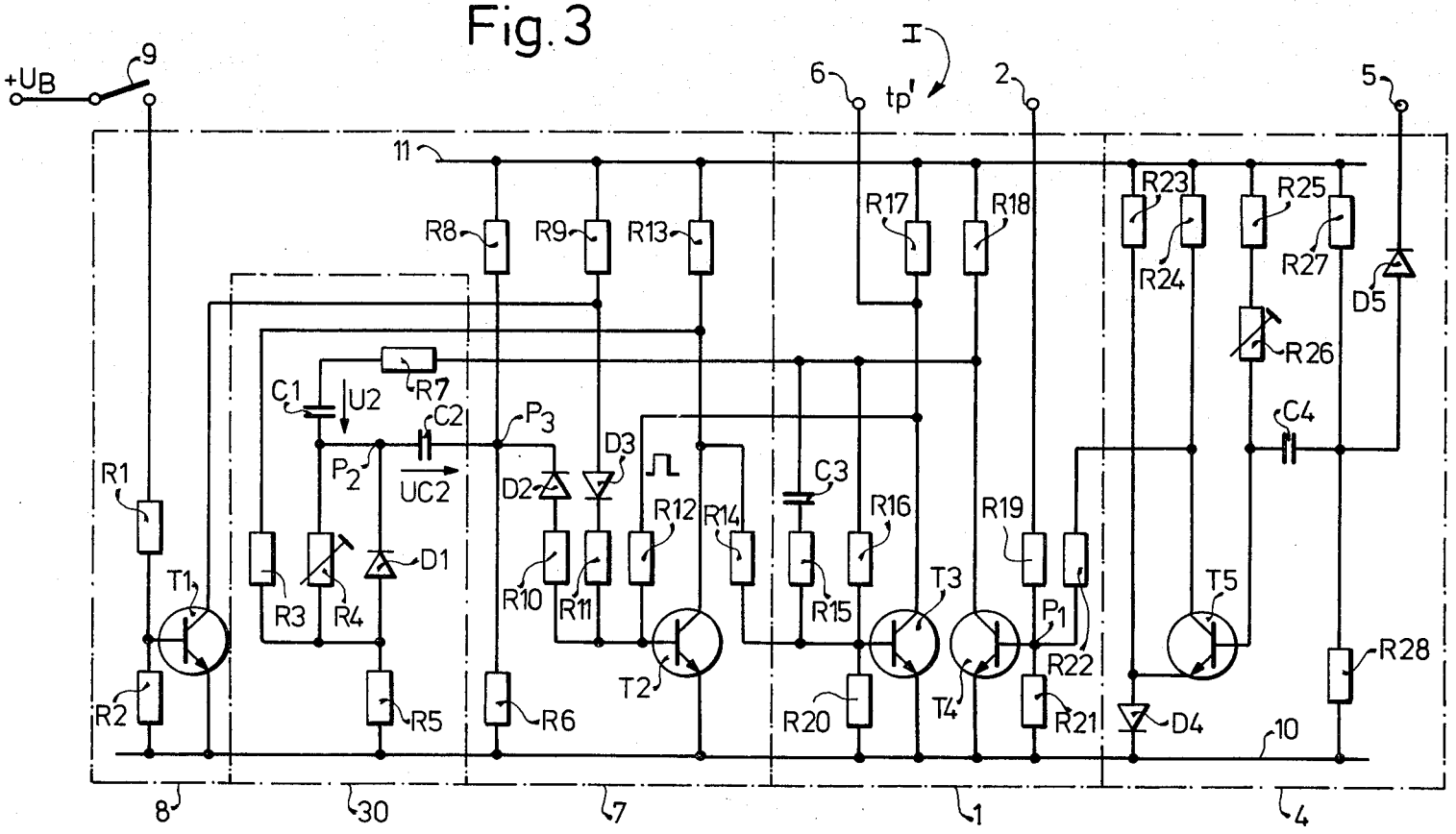

Reference is now made to the detailed circuit diagram of the circuit I illustrated in FIG. 3 which is used to generate curves illustrated in FIG. 2a which represent the duration of the injection pulse $t_i$ as a function of rpm during overrun operation. The dashed curve Y in the diagrams 2a to 2d is the normal behavior of the fuel injection pulses $t_i$ during engine overrun such as would be calculated from the prevailing rpm and the aspirated air quantity or the induction tube vacuum. All of the embodiments I–IV are so constructed that the circuit does not completely suppress the fuel injection pulses $t_i$ in a lower rpm domain but, under certain circumstances, merely increases their length leading to fuel enrichment. In this manner is obtained the effective actual duration of the injection pulses $t_i$ which is shown in the diagrams of FIG. 2 as a continuously drawn curve. In the diagram of FIG. 2a this curve exhibits three separate regions, a branch $a_1$ in which the circuit according to the present invention permits the use of the normally calculated injection pulse width, a branch $a_2$ in which, in a predetermined rpm domain, there is produced a fuel injection pulse of constant width (overrun enrichment) and a branch $a_3$ in which, beginning at a certain rpm, the injection pulses are completely suppressed. Similar remarks apply to the curves illustrated in FIGS. 2b–2d. The following discussion which relates specifically to the circuit I of FIG. 3 also applies to those parts of the circuits II–IV which have the same constructional elements. This fact will be indicated by the use of the same reference numerals.

Turning now to FIG. 3, there is illustrated a circuit diagram of the timing circuit 4 which is seen to include a transistor T5, the emitter of which is connected to ground or a minus potential 10 and is also connected via a resistor R23 to the positive potential bus 11. It will be understood that these designations are given only by way of example and for proper understanding but do not limit the invention to the use of the particular polarities cited; for a suitable choice of semiconductor elements, the polarities could be reversed. The collector of the transistor T5 is connected through a resistor R24 to the positive bus 11. The base circuit of the transistor T5 includes a capacitor C4 and two series resistors R25 and R26, the latter of which may variable. These components form an RC timing member which receives triggering pulses from an input contact 5 already discussed above, via a diode D5. A voltage divider consisting of series resistors R27 and R28 is connected between the two busses 10 and 11 and its junction is coupled to one electrode of the capacitor C4. It will be appreciated that the transistor T5 and its associated elements constitute a monostable flip-flop, i.e., a so-called economy mono, which is switched into its unstable temporary state by the negative going pulse of the triggering pulse train whereby the transistor T5 is caused to block and passes a positive pulse through the resistor R22 to a circuit point P1 in the transfer circuit 1. The positive pulse at P1 persists until the negative potential at the base of the transistor T5 has decayed through the series resistances R25 and R26. Thus, the duration of the positive pulse is predetermined and constitutes the above-mentioned minimum duration $t_{pmin}$. Pulses of this width dominate the duration of the injection pulses $t_p$ whenever the calculated normal injection pulse width $t_p$ would be shorter than the duration of the pulses $t_{pmin}$. For this purpose, the input contact 2 of the transfer circuit 1 also receives the already discussed injection pulse train $t_p$ which is passed through the resistor R19 to the same junction point P1 so that the condition of the transistor T4 is determined by the longer of the two otherwise synchronous pulses because P1 is connected to the base of the transistor T4. The junction P1 is connected to the line 10 via a resistor R21. The emitter of the transistor T4 is connected to the minus bus 10 and its collector is connected via a resistor R18 to the plus line 11. Thus the input pulses $t_p$ or $t_{pmin}$ change its collector potential and accordingly control a subsequent transistor T3, the collector of which carries the output pulse train $t_p'$ which is used for engaging the final control element of the fuel injection system that may be embodied as a multiplying circuit permitting inclusion of correcting factors. As already mentioned and as is visible from the circuits, the circuit consisting of the circuit blocks 1 and 4 transmits that pulse of the two pulses $t_p$ or $t_{pmin}$ which has the longer duration.

In order to perform the fuel cut-off during overrun, i.e., the behavior illustrated in the branch $a_3$ of FIG. 2*a*, there is provided the comparator circuit 7 which also affects the output transistor T3. This comparator circuit 7 includes a transistor T2 the emitter of which is grounded and the collector of which is connected to the positive line 11 via a resistor R13. The collector of the transistor T2 is further connected through a resistor R14 to the base of the previously mentioned output transistor T3 so that the output pulse train $t_p'$ is either passed out of the circuit or completely interrupted, thereby completely suppressing fuel injection.

For the improved comprehension of the function of the comparator circuit 7, there will first be explained a portion of the circuit serving for the control of the transistor T2 and connected to its base. The latter circuitry consists of a resistor R7 connected in series with a capacitor C1 and connected to the collector of the transistor T4 in the transfer circuit 1. The capacitor C1 is connected at its other electrode with three further elements and the junction point is referred to as P2. Also connected to the junction point P2 is the cathode of a diode D1 which is further connected through a resistor R5 to ground; parallel to the diode lies an adjustable resistor R4. Further connected to the junction P2 is a capacitor C2, the other electrode of which constitutes a junction point P3 which is coupled to the junction of two resistors R8 and R6 that constitute a voltage divider lying between the plus and minus supply lines and maintain a constant voltage at point P3 under steady-state conditions. Also connected to the point P3 is the cathode of a further diode D2 connected in series with a resistor R10 to the base of the transistor T2, and further connected to the base of the transistor T2 is the series connection of a resistor R11, a diode D3 and a resistor R9 connected to the positive supply line 11. Finally, the base of the transistor T2 is also connected through a resistor R12 to the collector of the transistor T3. The junction of the diode D3 and the resistor R9 is connected to the collector of a further switching transistor T1 which is part of the circuit 8 in FIG. 1 and the switching state of which depends on a switch 9 actuated by the throttle plate of the engine. If the throttle plate is closed, i.e., if the engine is operating in the overrunning condition, then the switch 9 would be closed and the base of the transistor T1 would receive a positive potential defined by the ratio of series resistors R1 and R2, causing it to conduct and thus lowering the potential at the junction of the diode D3 and the resistor R9 and causing the diode D3 to block conduction so that this part of the circuit plays no role in supplying potential to the base of the transistor T2 whenever the throttle plate is closed.

The circuitry connected to the base of the transistor T2 operates as follows. The alternating rectangular potential according to the pulse train $t_p$ or $T_{pmin}$ which is always present at the collector of the transistor T4 flows through the resistor R7 and the capacitor C1 to the junction point P2 and depending on whether these pulses are positive or negative, there results a different time constant of the circuit, because negative pulses can pass the diode D1 so that only the resistance R5 is of significance, whereas positive pulses go via the adjustable resistor R4. Accordingly, after each positive potential jump, the positive voltage at the junction P2 decays only slowly and, depending on the frequency of the pulse trains $t_p$ or $t_{pmin}$, the potential at the point P2 will have reached the static potential at the point P3 if the frequency is sufficiently low or a remanent excess voltage $U_{C2}$ will be transmitted via the capacitor C2. Due to the substantially shorter time constants resulting from negative square pulses, the negative pulse will have the appearance of a negative spike at the point P3 but its amplitude or the negative value which controls the subsequent transistor T2 depends on the overall condition of the input circuit which includes the capacitors C1 and C2 at the moment of the onset of the negative edge. In other words, it depends on the degree to which the positive potentials at the point P2 have decayed and on the magnitude of the remanent capacitor potential $U_{C2}$. It will be appreciated that when the rpm increases, and thus the frequency of the pulse trains $t_p$ or $t_{pmin}$ also increases, the potential at point P2 will have less and less opportunity to decay to the steady-state value prevailing at the point P3. On the other hand however, the remanent differential voltage $U_{C2}$ is added to the peak voltage of the negative pulse so that, when the rpm increases, the negative pulse increases in amplitude at the point P3 and is fed through the series connection of the diode D2 and the resistor D10 to the base of the transistor T2. The sequence of events may also be illustrated by considering that, when the pulse duration decreases (increasing rpm), the positive pulse is able to bring only a small number of positive charge carriers into the input circuit whereas the negative pulse rapidly discharges the energy storages C1 and C2.

According to the above, the arrival of each negative spike at the base of the transistor T2 would be expected to block the transistor. However, the circuit further includes the peculiarity that the same rectangular pulse train present at the collector of the transistor T4 is simultaneously fed to the base of the transistor T3 via a capacitor C3 and a resistor R15. Due to the differentiating effect of the RC member C3–R15, a negative decaying pulse arrives which causes a short term blockage of the transistor T3. Therefore the collector of the transistor T3 which is at high potential causes the base of the transistor T2 to experience a short term positive rectangular pulse the duration of which can be limited by appropriate dimensioning of the RC member C3–R15 to approximately 10 microseconds in the exemplary embodiment shown. This positive rectangular pulse which arrives at the base of the transistor T2 at the same time as the previously described negative spike is added to it and the transistor T2 is blocked or rendered conducting depending on the changing magnitude of the negative spike.

If the frequency of the controlling pulse train $t_p$ or $t_{pmin}$ is relatively low, the transistor T2 will always be conducting because, in that case, the amplitude of the negative spike coming from the input circuitry will be too small so that the short positive pulse will be predominant. When the transistor T2 conducts, the subsequent output transistor T3 blocks, causing its collector to be at high potential and, as the collector of the transistor T3 as already explained is connected via the resistor R12 to the base of the transistor T2, both transistors T2 and T3 are blocked and thus form a bistable circuit. Hence the transmitted $t_p$ pulse immediately follows the short positive pulse so as to produce the collector potential behavior of the transistor T3 which is illustrated in FIG. 7*b* and designated as the output pulse $t_p'$. Thus, at this relatively low rpm, the state of the circuitry will correspond either to branch $a_1$ of FIG. 2*a* or the branch $a_2$ if the regularly calculated $t_p$ pulses have become so short that the control of the transistor T4 at the junction P1 has been taken over by the pulse train $t_{pmin}$ generated by the timing circuit 4. However if, during overrunning operation, the engine reaches higher rpm, according to what has already been discussed, the amplitude of the negative spike at the junction point P3 increases until the transistor T2 is blocked or held blocked, thereby causing the transistor T3 to conduct, dropping its collector potential to near zero so that only the relatively short constant pulse 15 appears as the output pulse in FIG. 7*b*. This pulse was required for a comparison but its duration is so short that the subsequent circuitry does not react to it and in no case do the injection valves respond to this pulse. Thus the injection control pulses can be considered to be completely suppressed and the operational state corresponds to that illustrated in the branch $a_3$ of FIG. 2*a*. FIG. 7*a* shows the rectangular pulse train (inverted pulse train $t_p$) occurring at the collector of the transistor T4. FIG. 7*c* schematically shows the potential and hence the change in the amplitude of the negative spike at the junction P3.

The circuitry of FIG. 3 is so chosen that when the throttle plate switch 9 is open, the influence of the transistor T2 on the transistor T3 is suppressed, for in that case, the transistor T1 blocks and the transistor T2 is rendered conducting via the series connection of elements R9, D3 and R11 in its base circuit. Accordingly, its collector potential is lowered to such a degree that the transistor T3 is subject only to the control of the transistor T4 and its associated switching states. This situation corresponds to a bistable behavior of the transistors T3 and T4 based on the coupling effect on the resistor R16. Thus any influence of the transistor T2 on the output of the transistor T3 is limited to the switching state in which the transistor T2 blocks so that the base potential of the transistor T3 is so high that it can no longer respond to any control effect by the transistor T4. FIG. 2*a* also illustrates a necessary hysteresis effect which prevents a constant switching back and forth at a given rpm. This effect is obtained by connecting the junction of the diode D1 and the resistors R5 and R4 with the collector of the transistor T2 via a resistor R3. In this way, the potential to which the point P2 is discharged is relative to the collector of the transistor T2 and its switching state. Inasmuch as the transistor T2 is always blocked during pulse suppression and always conducts when suitable injection pulses $t_p'$ are generated, the switching points for going into the opposite state are subject to different conditions and thereby cause the hysteresis behavior.

Figure 4:
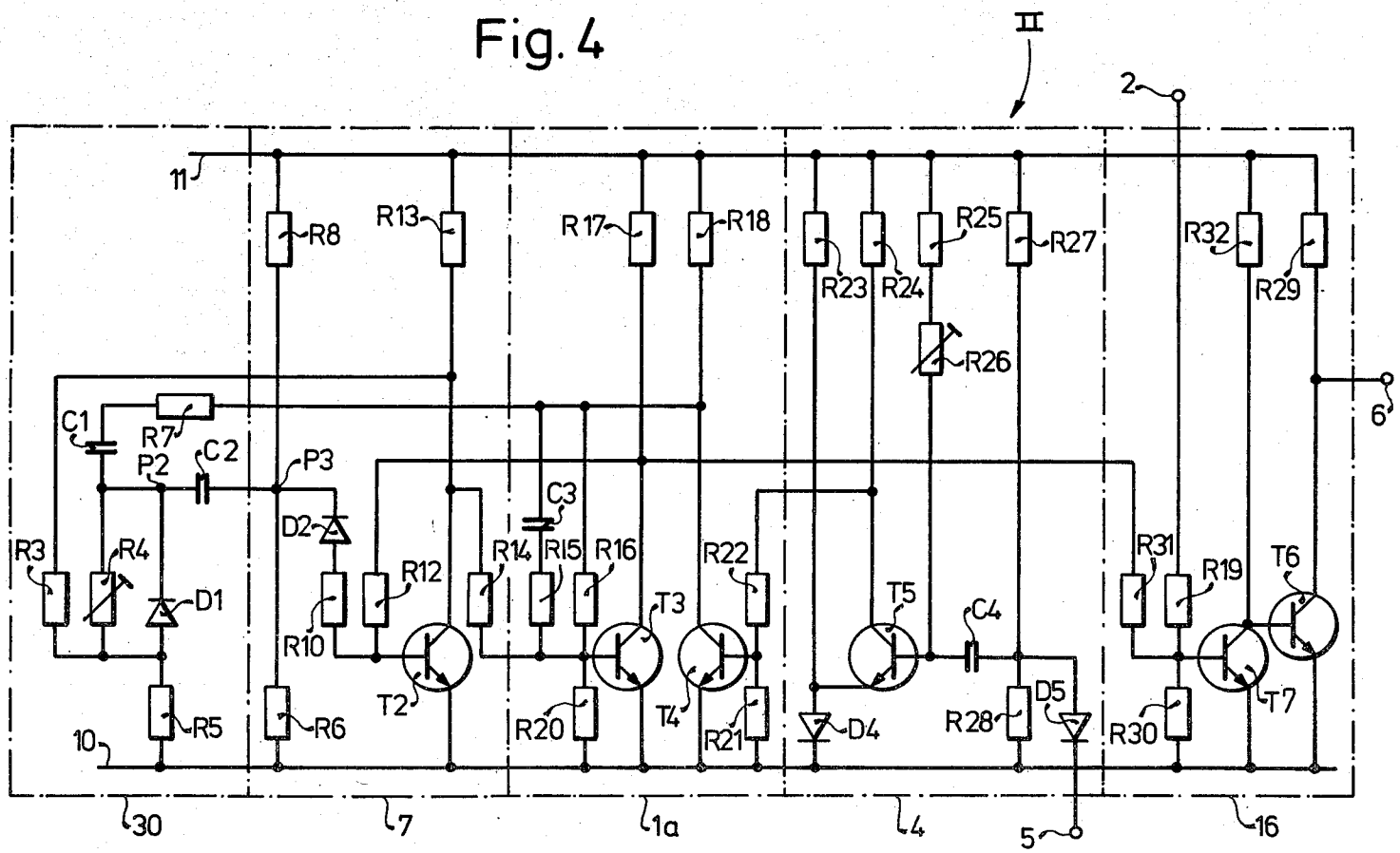
FIG. 4 illustrates a circuit diagram of a second exemplary embodiment of the invention resulting in the curves of FIG. 2b.

FIG. 4 illustrates the second embodiment of the invention, i.e., the circuit II, which is related to the intended behavior of the fuel injection duration $t_i$ as a function of rpm as shown in FIG. 2*b*. FIG. 2*b* illustrates curves which insure a pulse of minimum duration $t_{pmin}$ whenever overrunning occurs below a given rpm; above this limit the circuit switches over to a state in which the pulses $t_p$ which are calculated by other parts of the fuel injection system from rpm and air quantity are transmitted without change. It should be noted that the dashed Y curves in FIGS. 2*a* to 2*d* merely indicate a possible behavior of the pulse durations of the pulses $t_p$; for example in FIG. 2*b*, the calculated period of $t_p$ could lie below the $t_{pmin}$ curve for the entire overrunning operation. In the illustration of FIG. 2*b*, the curve Y intersects the $t_{pmin}$ curve so that from this rpm on, the circuit of FIG. 4 takes over the generation of output pulses $t_p$, until that limit is reached at which there takes place a new switchover as already discussed with respect to FIG. 3. However, in the example of FIG. 4 the switchover has the result of returning to operation with the calculated curve Y which corresponds to a duration of injection pulses $t_i$.

Figure 8:
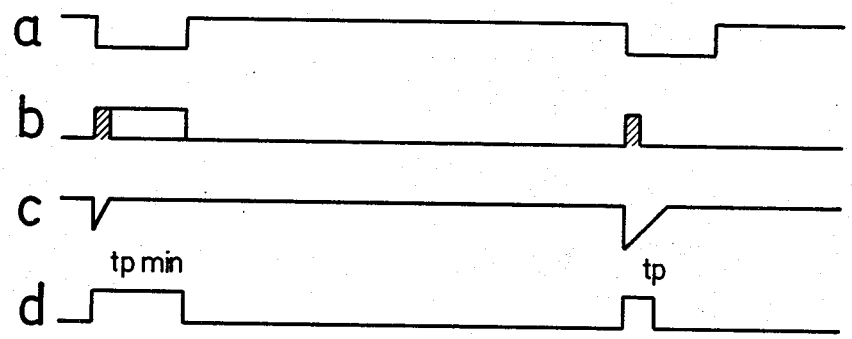
FIG. 8 is a similar diagram illustrating voltages as a function of time in various points of the circuit II of FIG. 4.
Figure 9:
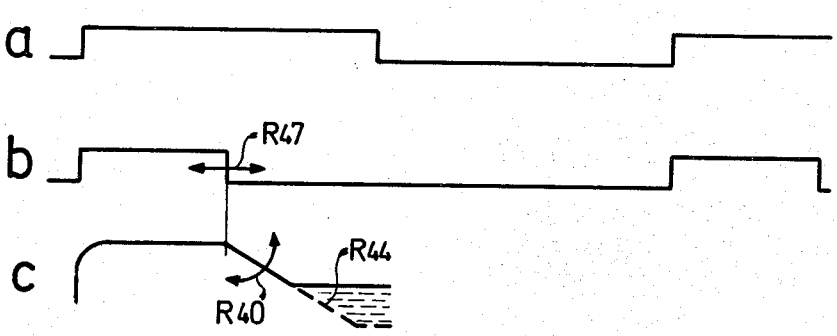
FIG. 9 illustrates voltages as a function of time at various points of the circuit III of FIG. 5.
Figure 10:
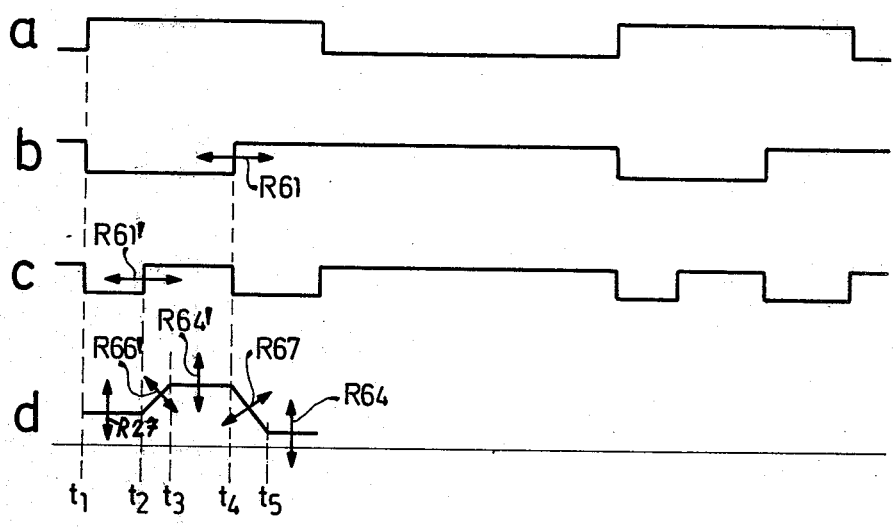
FIG. 10 illustrates voltages at various points of the circuit IV of FIG. 6.

The circuit of FIG. 4 differs from that of FIG. 3 in that the base of the transistor T4 no longer receives the $t_p$ pulses but only the $t_{pmin}$ pulses from the timing circuit 4. Furthermore, this exemplary embodiment has no switching circuit 8. The $t_p$ pulse train goes from the input contact 2 through the resistor R19 to the base of an additional transistor T7 which forms a pure inverter stage with a subsequent transistor T6. The emitters of both transistors T7 and T6 are connected to the minus or ground line 10 while the collectors are connected to the positive supply line 11 via resistors R32 and R29. The collector of the transistor T6 then carries the output injection pulse sequence $t_p'$. The base of the transistor T7 additively receives the pulse train $t_{pmin}$ from the output transistor T3 as well as the sequence $t_p$ which the fuel injection system generates substantially from rpm and air quantity data so that, as before, the longer lasting of the two pulses is transmitted. FIG. 2*b* shows that at the rpm $n_1$, the duration of the prevailing $t_p$ pulse is shorter than the duration of the $t_{pmin}$ pulse so that the latter subsequently controls the output transistors T7 and T6. This condition prevails until the increasing negative spikes at the point P3 block the transistor T2 and render the transistor T3 conducting so as to suppress any further contribution of the circuit elements 7, 1*a* and 4 in FIG. 4 and exclude them from taking a part in the generating of the output pulse sequence $t_p'$. Several important voltage characteristics of the circuit of FIG. 4 are illustrated in FIGS. 8*a* to 8*d*. The first three curves of FIG. 8 are substantially similar to those of FIG. 7 whereas FIG. 8*d* illustrates the output voltage of the transistor T6. As long as the negative spike in FIG. 8*c* is small enough, the output signal presented by the timing circuit 4 is the $t_{pmin}$ and when the limiting rpm has been exceeded and if the negative spike is sufficiently large, the transistor T2 blocks so that the output of the transistor T6 only carries the normal fuel injection pulse $t_p$.

Figure 5:
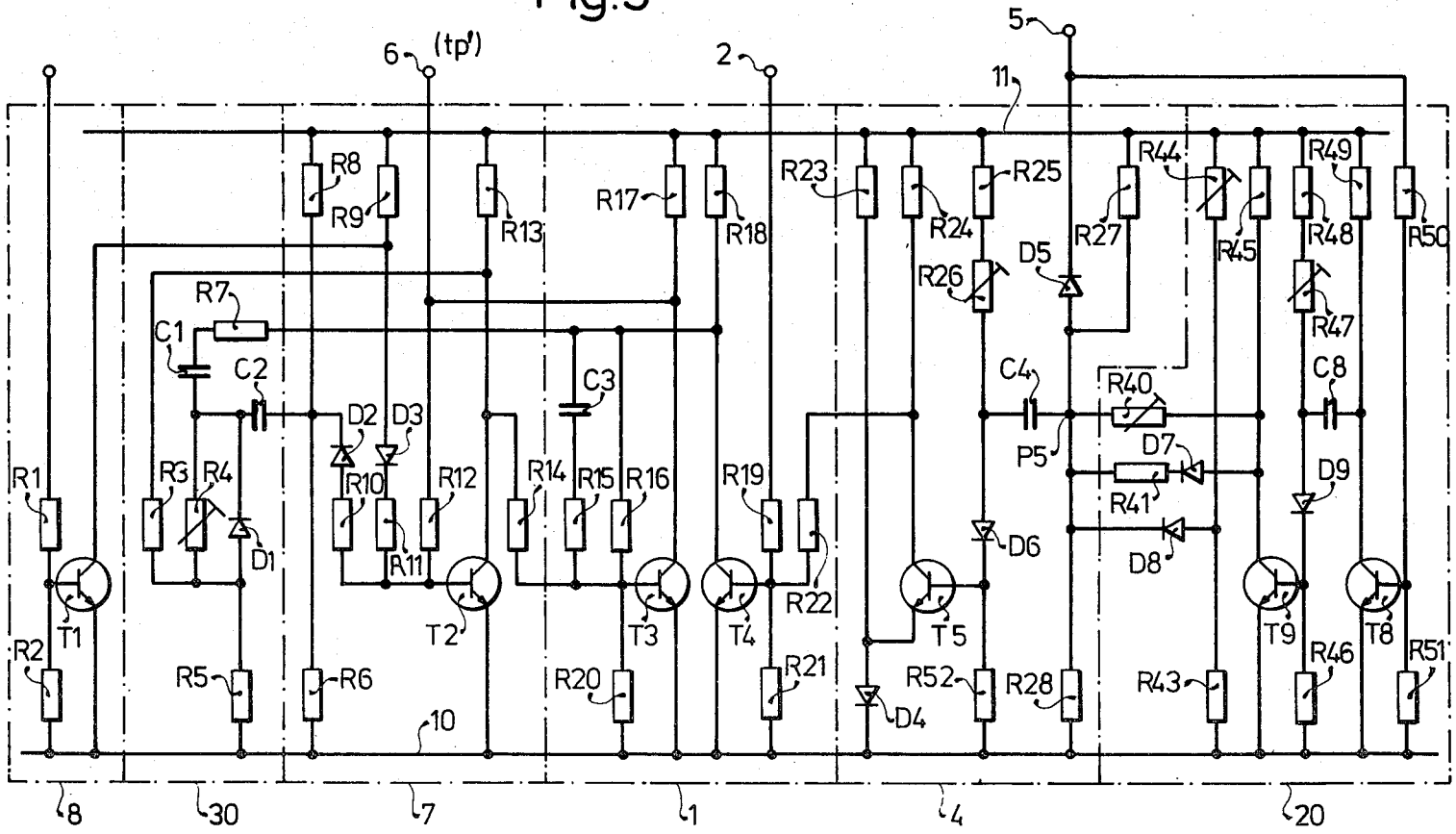
FIG. 5 is a circuit diagram of a third exemplary embodiment of a fuel injection system according to the invention resulting in the curves of FIG. 2c.

The third embodiment of the invention of FIG. 5 is capable to take into account an even more complicated scheme of interdependence of the fuel injection pulses $t_i$ or $t_p'$ illustrated in the curve 2*c*. As shown there, the circuit of FIG. 5 generates a first minimum pulse train $t_{pmin1}$ having a first constant pulse duration (unless the normally calculated pulses $t_i$ of the fuel injection system have a longer duration, i.e., as illustrated in the curve Y). From a value of rpm $n_2$ until an rpm $n_3$, the $t_{pmin}$ pulses presented by the circuit of FIG. 5 increase continuously in width until they reach a second constant value at the rpm $n_3$ which is then maintained up to the limiting rpm where the already explained switchover to fuel cut-off or to free transfer of the normally calculated $t_p$ pulses takes place. In the present exemplary embodiment, a complete cut-off occurs at the limiting rpm. In order to achieve this result, the circuit of FIG. 5 has a supplementary timing circuit 20 associated with the first timing circuit 4 and so constructed that the durations of the $t_{pmin}$ pulses generated by the first timing circuit 4 are subjected to an additional dependence on engine rpm. All the other elements of the circuit in FIG. 5 are identical to those discussed with respect to the circuit of FIG. 3 and will not be further explained. The output of the supplementary circuit 20 is coupled into the junction of the diode D5 and the capacitor C4 of FIG. 4 and this point is designated P5 in the circuit of FIG. 5. The supplementary circuit 20 includes a first transistor T8 the emitter of which is connected directly to the ground line 10 and the base of which is connected to a base voltage divider consisting of resistors R50 and R51 and receives therefrom the symmetrical triggering pulse sequence, i.e., the triggering pulse sequence $t_a$ as illustrated in FIG. 9*a* and as received at the input contact 5. The inverted signal passes through a collector resistor R49 to a subsequent timing stage in the form of an economy mono, substantially consisting of the transistor T9 and an RC timing member consisting of an adjustable resistor R47 and a resistor R48 as well as a capacitor C8. The emitter of the transistor T9 is grounded and its base is connected to a tap of a voltage divider lying between the positive and negative supply lines and containing the resistors R48 and R47, a diode D9 and a further resistor R46, the base connection being made between the junction of the cathode of the diode D9 and the resistor R46. The timing capacitor C8 is connected between the collector of the transistor T8 and the junction of the diode D9 and the resistor R47. The collector of the transistor T9 is connected to the plus line 11 via a resistor R45. The circuit junction point P5 is connected via an adjustable resistor R40 to the collector of the transistor T9; parallel thereto is a series connection of a further resistor R41 and a diode D7. Finally, the second timing circuit includes a voltage divider consisting of resistors R44 and R43 lying between the plus and minus lines, the value of which is adjustable preferably via the resistor R44. The junction of the resistors R44 and R43 is connected through a diode D8 to the junction point P5.

It is the main function of the second timing circuit 20 to change the potential at the junction point P5 which would have been constant in the exemplary embodiment of FIG. 3, in such a manner that different potentials are realized in dependence of the prevailing rpm so that the triggering pulse which reaches the junction point P5 through the diode D5 also has different rpm-dependent potentials. Accordingly, there is an additional dependence of the economy mono in the first timing circuit 4 on rpm. This construction results in the following operation. The positive pulse which reaches the junction of the capacitor C8 and the resistor R47 through the inverting transistor T8 blocks the diode D9 until the capacitor C8 is discharged through the adjustable resistor R47. During the period of blockage of the diode D9, the base of the transistor T9 is connected to ground via the resistor R46, the transistor T9 also blocks and the capacitor C4 of the first timing circuit 4 is charged to positive potential through the series connection of the resistor R41, the diode D7 which conducts, and the resistor R45 in the collector circuit of the transistor T9. On the other hand, it will be easily seen that the time constant of the economy mono including the transistor T5 is determined by the charge on the capacitor C4. If the junction point P5 is at a high potential, the first timing circuit 4 has a longer time constant and thus the duration of the $t_{pmin}$ pulse generated thereby is greater. If the rpm is reduced, i.e., if the time periods between the triggering pulses of the triggering pulse sequence become greater, then the timing circuit 20 has sufficient time to return back to its stable state in which the transistor T9 conducts. As as consequence, the positive voltage previously built up at the junction point P5 can decay through the adjustable resistor R40 and the collector emitter path of the transistor T9 to ground. Thus the potential at the point P5 drops and the duration of the $t_{pmin}$ pulse declines continuously during a predetermined rpm interval (the interval $n_3$–$n_2$ in FIG. 2*c*). When the rpm decreases further, the potential at the junction point P5 finally causes the diode D8 to conduct. From this rpm on, the potential at the junction P5 is determined by the voltage dividing ratio of resistors R43 and R44. From this rpm on, the value of $t_{pmin}$ is constant again as shown in FIG. 2*c* in the branch $a_4$. The transition region is labeled $a_5$ and the upper constant value $t_{pmin2}$ is labeled $a_6$. In other ways, the circuit is identical to that of FIG. 3 so that fuel cut-off occurs as in FIG. 2*a*. All of the illustrated switchover rpms are adjustable; the switchback timing of the transistor T9 (and hence the onset of discharging of the capacitor C4 through the resistor R40) is determined by adjustment of the resistor R47. The rate of discharge (corresponding to the increase of the curve branch $a_5$ of FIG. 2c) is determined by the adjustment of the resistor R40. As may also be seen in the circuit of FIG. 5, the lowest voltage at the junction point P5 occurs when the diode D8 conducts and is set by adjusting the resistor R44.

It should be noted at this point that, generally speaking, the pulse train $t_p$ as well as the finally corrected injection pulse train $t_i$ which are calculated by the fuel injection system under normal conditions can be suitably regarded as generally correct even though some engine types require different injection times, especially in overrunning operation, so as to prevent excessive engine cooling and/or the explosion of uncombusted fuel in the exhaust system.

Figure 6:
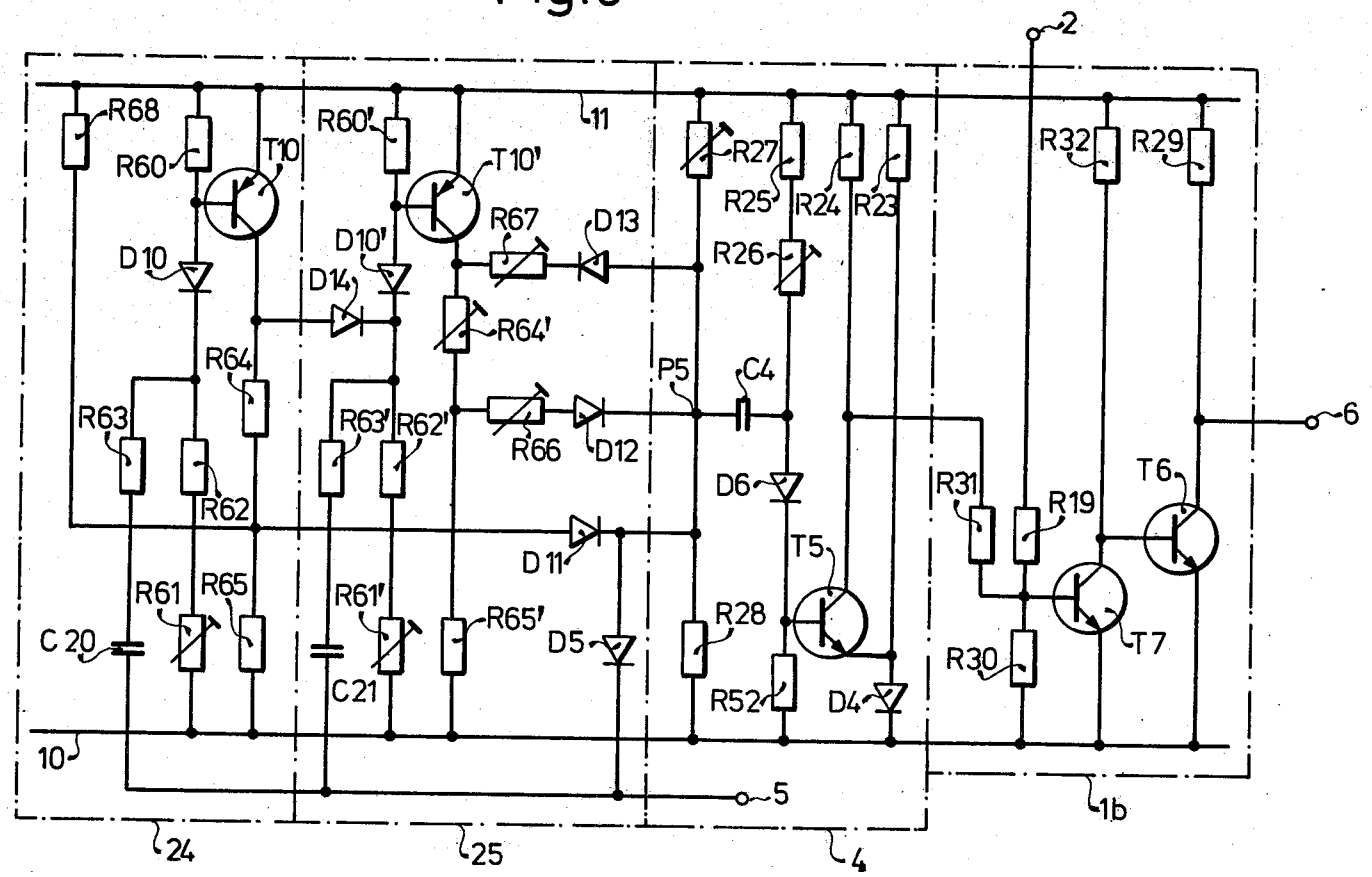
FIG. 6 is a circuit diagram of a fourth exemplary embodiment of a fuel injection system resulting in the curves of FIG. 2d.
Figure 7:
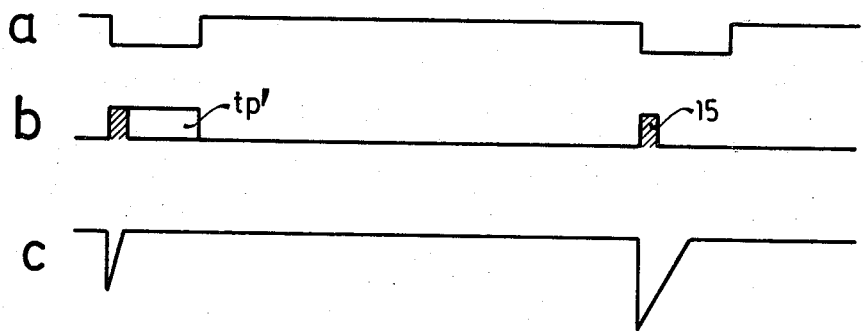
FIG. 7 is a series of diagrams showing the timing of voltages at various points in the circuit I of FIG. 3.

The illustration of FIG. 6 depicts the circuit diagram of a fourth exemplary embodiment of the invention similar to that of FIG. 4 and including the same output stage 1b which receives the $t_p$ sequence at the contact 2 through a resistor R19 and its own pulse sequence which has the characteristics illustrated in FIG. 2d with respect to rpm, for summation or selection via the resistor R31. The output of the circuit 1b then exhibits an injection pulse corresponding to the longer of the two input pulses for further processing.

The circuit of FIG. 6 also includes the first timing circuit 4 corresponding to the illustration of FIG. 5 although the collector of the transistor T5 is here coupled directly through the resistor R31 to the base of the transistor T7. The first timer circuit 4 receives its triggering pulse from the input contact 5 carrying rpm-synchronous triggering pulses which are transmitted through the diode D5 to the junction P5. The present exemplary embodiment is similar to that of FIG. 5 in that the junction point P5 is exposed to additional potential shifting influences which are rpm-dependent so that the final rpm-dependent curve of FIG. 2d is achieved. To achieve this effect, there are included two further timing circuits in the form of monostable flip-flops 24 and 25, built in the configuration of economy monos which also receive the triggering pulse sequence via capacitors C20 and C21. The two economy mono circuits are substantially symmetric so that only one will be explained in detail, the other has corresponding elements which are identified by primes. The monostable flip-flop 24 has a transistor T10, the emitter of which is connected directly to the positive line (it is of the opposite polarity as the previously used transistors). Connected to the base of the transistor T10 is the series connection of the voltage divider circuit including resistors R61, R62, a diode D10 and a resistor R60 all connected between the positive and negative lines, and the input triggering pulse is fed to the junction of the diode D10 and the resistor R62 via the capacitor C20 and a further resistor R63. The resistor R61 is adjustable. The collector of the transistor T10 is connected to the ground line 10 via two further resistors R64 and R65 connected in series. The junction of the resistors R64 and R65 is connected via a diode D11 to the junction point P5 as is the junction of the resistors R64' and R65' associated with the transistor T10', in this case via the series connection of an adjustable resistor R66 and a diode D12. The collector of the transistor T10' is connected to the junction P5 through the series connection of a resistor R67 and a diode D3 connected in reverse sense to the diode D12. The collector of the transistor T10 is connected through a diode D14 to the junction of the resistor R62' and the diode D10' in the base circuit of the transistor T10'. The junction of the resistors R64 and R65 is connected through a resistor R68 to the positive supply line 11. The circuit of FIG. 6 operates in the following manner. The initial position is such that the two economy mono flip-flops 24 and 25 are normally conducting when the diodes D10 and D10' are conducting. They are switched into their unstable state by positive pulses or positive pulse edges arriving through the capacitors C20 and C21 from the input contact 5. Depending on the frequency of the triggering pulse sequence, i.e., the rpm n, they prepare the potential at the point P5. The negative pulse of the triggering sequence then passes through the capacitor C4 and triggers the first timer circuit 4 thereby generating the desired $t_{pmin}$ pulse according to the curve of FIG. 2d whose length is determined by the potential at point P5 and countered by the negative triggering pulse.

Let it be assumed for explanation that the circuit begins at a time at which the two transistors T10 and T10' of the economy mono flip-flops 24 and 25 are both blocked due to positive triggering pulses which pass through the capacitors C20 and C21 and which block the diodes D10 and D10' thereby also blocking the two transistors. When the two transistors are blocked, the potential at the point P5 is defined by the voltage divider resistors R27 and R28. The circuits are also constructed that the transistor T10 blocks for a longer period of time than the transistor T10' which returns to its conducting state sooner and connects the junction point P5 to positive potential via the resistors R64, R66 and the diode D12, so that this point experiences a potential increase. The increase of potential takes place at a time constant determined by the resistor R66 and the capacitor C4 until a maximum value is reached which is equal to the voltage dividing ratio of the resistors R64' and R65'. After a further period of time, assuming that the voltage at the point P5 has assumed a steady value, the transistor T10 also returns to its normal conducting state and blocks the transistor T10' via the diode D14. Thus the positive potential at the junction point P5 decays through the properly connected diode D13, the resistor R67 and the series connection of resistors R64 and R65 to the ground line 10. This decrease of potential is terminated when the diode D11 becomes conducting so that the potential at the point P5 is set to the lower value formed by the junction of the resistors R64, R65 and R68. The manner of operation is further illustrated by the curves 10a to 10d. The voltage illustrated in 10a is the triggering pulse sequence at the input contact 5 whose positive edge blocks the transistors T10 and T10' at the time $t_1$ and whose collector potentials indicated by the curves 10b and 10c drop to substantially zero. Thus the collector potential of the transistor T10' (FIG. 10c) returns to positive potential at the time $t_2$ resulting in the increase of voltage at the point P5, indicated in FIG. 10d and determined by the resistor R66'. The constant potential occurring during the time that both transistors T10 and T10' are blocked is determined by the adjustment of the resistor R27.

The voltage plateau obtaining from the point $t_3$ to the point $t_4$ is determined by the magnitude of the resistor R64'. After the expiration of the unstable time of the transistor T10 as seen in FIG. 10b, the transistor T10' blocks again, resulting in a voltage decrease at the junction point P5, the slope of which is determined by the adjustment of the resistor R67. From the point $t_5$ on, the magnitude of the constant potential is determined substantially by the resistor R64 but also by the resistor R68. The timing points at which these switchovers occur are defined by the resistors R61' and R61 which, together with the capacitors C20 and C21 constitute the RC members which govern the timing of the economy mono flip-flops 24 and 25.

Depending on the prevailing rpm, the negative triggering pulse arrives at the first timing circuit 4 through the diode D5 and "catches" the changing potential at the point P5 at any desired point of time so that there results a corresponding dependence of the duration of the $t_{pmin}$ pulses generated by this first timing circuit 4. Thus the curves of FIG. 2*d* are substantially the same as those of FIG. 10*d* but it should be noted that FIG. 10*d* represents an actual voltage shift at the junction point P5 whereas the curves of FIG. 2*d* indicate the duration of injection pulses of a pulse sequence $t_p$ as a function of rpm. FIG. 2*d* also includes a curve Y of the normally calculated pulse duration and the output stage 1*d* of the circuit of FIG. 6 insures that the longer of the two pulses $t_p$ or $t_{pmin}$ is used to generate the injection pulse sequence $t_p$.

The foregoing relates to preferred exemplary embodiments of the invention, it being understood that other embodiments and variants thereof are possible within the spirit and scope of the invention, the latter being defined by the appended claims.

What is claimed is:

1. A fuel injection system for an internal combustion engine, comprising, in combination:
   - electromagnetic fuel injection valves associated with combustion cylinders of the engine;
   - means for generating primary fuel injection valve control pulses from trigger signals related to engine rpm and from signals related to the aspirated air flow rate;
   - storage means for storing electrical values related to engine data;
   - comparator circuit means for generating comparison pulses from said stored electrical values;
   - transfer circuit means, connected to accept information from said comparator circuit means for providing selective passage of said fuel injection valve control pulses to said fuel injection valves; and
   - timer means including a timing input circuit, actuated by rpm-related signals, for generating secondary fuel injection control pulses of minimum duration for passage to said transfer circuit means.

2. An apparatus as defined by claim 1, wherein said timer means includes a transistor the base of which is coupled to an RC member receiving said trigger signals and wherein the output of said timer means is connected to a first switching transistor of said transfer circuit means and wherein said first switching transistor also receives said primary fuel injection control pulses.

3. An apparatus as defined by claim 2, wherein said transfer circuit means further includes an output transistor controlled by said first switching transistor and wherein said comparator circuit means includes a transistor the switching state of which is coupled to the base of said output transistor in said transfer circuit means.

4. An apparatus as defined by claim 3, wherein the switching state of said transistor in said comparator circuit means is by said triggering pulses or said primary fuel injection pulses in that its base is coupled to said storage means and wherein said storage means exhibits different time constants for positive and negative incoming pulses.

5. An apparatus as defined by claim 4, including negative and positive potential supply lines and wherein said storage means coupled to the base of said transistor in said comparator circuit means includes the series connection of a first capacitor and a diode connected to said negative potential supply line and a second capacitor coupled to the junction of said first capacitor and said diode, the other side of said second capacitor being coupled to a voltage divider circuit consisting of at least two resistors connected between said positive and negative potential supply lines, their junction P3 being connected via further circuit elements to the base of said transistor in said comparator circuit means; whereby said junction P2 of said first and second capacitors and said diode exhibits a potential the magnitude of which depends on the period of said triggering pulses and which enhances or reduces the voltage pulse passing through said diode.

6. An apparatus as defined by claim 5, wherein said storage means includes an adjustable resistor in parallel with said diode, the resistance of said adjustable resistor in said first and second capacitors defining the decay constant of the voltage at the junction point P2 which is blocked by said diode, whereby there is produced at point P2 a preferably negative voltage spike, the magnitude of which depends on the engine rpm, said negative spike being connected to the base of said transistor in said comparator circuit means to be compared with a preferably positive pulse of constant amplitude and whereby, depending on the result of said comparison, said transistor in said comparator circuit means is made conducting or non-conducting and, by blocking said output transistor in said transfer circuit means, completely suppresses the transfer of said primary fuel injection control pulses for a given range of rpm.

7. An apparatus as defined by claim 6, wherein said positive pulse which is used for comparison with said negative voltage spike is formed by short term actuation of said output transistor in said transfer circuit means being controlled by said first switching transistor in said transfer circuit means via an RC member and wherein the collector of said output transistor in said transfer circuit means is connected to the base of said transistor in said comparator circuit means via a resistor and whereby, when the comparison of said negative voltage spike and said positive pulse results in a more positive residual signal at the base of said transistor in said comparator circuit means, the output transistor of said comparator circuit means blocks said first transistor of said comparator circuit in bistable manner to prevent transfer of said primary fuel injection control pulses.

8. An apparatus as defined by claim 3, wherein said transfer circuit means further comprises a second transistor controlled by said output transistor in said transfer circuit means and wherein said second transistor receives simultaneously said primary and secondary fuel injection control pulses.

9. An apparatus as defined by claim 8, further including a third transistor which together with said second transistor constitutes an inverter wherein the base of said second transistor receives said primary fuel injection control pulses and said secondary fuel injection control pulses from said output transistor.

10. An apparatus as defined by claim 1, further comprising second timer means having a transistor also actuated by rpm related signals for rpm-dependent adjustment of the potential in the timing input circuit of said first timer means whereby, for low engine rpm, said secondary fuel injection control pulses have a duration which increases with increasing rpm up to a limiting rpm from which a second secondary fuel injection control pulse of larger duration is generated.

11. An apparatus as defined by claim 10, wherein said second timer means includes a monostable multivibrator including a transistor with a timing RC member in its base circuit and an inverting transistor connected ahead of said transistor.

12. An apparatus as defined by claim 11, wherein the collector of said transistor in said second timer means is connected to a positive supply line via a resistor and is connected to the input of said first timer means via a diode in series with a resistor.

13. An apparatus as defined by claim 12, wherein said second timer means and said first timer means are further coupled through an adjustable resistor and wherein the input of said first timer means is coupled through a diode to the junction of an adjustable voltage divider for generating a lower positive minimum potential at said input of said first timer means.

14. An apparatus as defined by claim 12, wherein the input of said first timer means receives said rpm-dependent trigger pulses via a diode; whereby the time constant of said first timing means at said input changes according to said potential provided at said input by said second timing means.

15. An apparatus as defined by claim 1, wherein said comparator circuit means exhibits hysteresis in the region of cut-off rpm.

16. An apparatus as defined by claim 15, wherein said storage means includes a diode and a resistor connected to a negative supply line, wherein the junction of said diode and said resistor is connected to the collector of a first transistor of said comparator circuit means.

17. An apparatus as defined by claim 1, wherein the engine includes a throttle plate and further comprising a switch associated with said throttle plate of the engine for controlling a switching transistor which is coupled to said comparator circuit means; whereby, when said trottle plate is open in normal engine operation, the transistor of said comparator circuit means receives a potential causing it to conduct and thereby to suppress the influence of said comparator circuit means on said transfer circuit means.

18. A fuel injection system for an internal combustion engine, comprising, in combination:

electromagnetic fuel injection valves associated with combustion cylinders of the engine;

means for generating primary fuel injection control pulses from trigger signals related to engine rpm and from signals related to the aspirated air flow rate;

transfer circuit means for providing selective passage of said fuel injection control pulses to said fuel injection valves;

timer means including a timing circuit, actuated by rpm related signals, for generating secondary fuel injection control pulses to be fed to said transfer circuit means for superposition with said primary fuel injection control pulses, said timer means including two monostable multivibrators having timing capacitors with differing time constants the switching of which controls the charging and discharging of the timing capacitor of one of said two monostable multivibrators.

19. An apparatus as defined by claim 18, wherein the output of said timing circuit is connected through a resistor to a first transistor in said transfer circuit means and wherein said two monostable multivibrators are actuated by said trigger signals related to engine rpm.

20. An apparatus as defined by claim 19, wherein each of said monostable multivibrators includes a transistor and an RC member connected to its base, the RC members being so constructed as to provide different unstable time constants for said monostable multivibrators.

21. An apparatus as defined by claim 19, wherein said monostable multivibrator having the shorter unstable time constant is connected via unipolar conducting elements to the input of said timer means whereby the potential of said timer means depends on the switching state of the first of said two monostable multivibrators and wherein the monostable multivibrator having the longer unstable time constant is so connected with said monostable multivibrator having the shorter time constant that the latter can be returned to its unstable state.

* * * * *